United States Patent [19]

van der Sluijs

[11] 4,163,373

[45] Aug. 7, 1979

[54] DEVICE FOR EXTRACTING MOISTURE FROM A SPACE

[75] Inventor: Willem L. N. van der Sluijs, Eindhoven, Netherlands

[73] Assignee: U.S. Philips Corporation, New York, N.Y.

[21] Appl. No.: 859,645

[22] Filed: Dec. 12, 1977

[30] Foreign Application Priority Data

Jul. 2, 1977 [NL] Netherlands ..... 7701242

[51] Int. Cl.[2] ..... F25B 47/00

[52] U.S. Cl. ..... 62/279; 62/82; 55/196; 55/32; 55/269

[58] Field of Search ..... 55/29–32, 55/388–390, 221, 269, 196; 62/93, 94, 277, 279, 280, 82; 261/107, 154, 140 R, 140 A

[56] References Cited

U.S. PATENT DOCUMENTS

| | | | |
|---|---|---|---|
| 998,975 | 7/1911 | Mies | 261/140 R |
| 2,902,834 | 9/1959 | Bosworth | 55/390 |
| 3,311,355 | 3/1967 | Rait | 55/29 |
| 3,977,364 | 8/1976 | Gijsbers et al. | 261/107 |

*Primary Examiner*—Bernard Nozick

*Attorney, Agent, or Firm*—Thomas A. Briody; William J. Streeter; Rolf E. Schneider

[57] ABSTRACT

A refrigerator is provided with a continuous length of capillary material that extends via an opening in the refrigerator wall into contact with an evaporator in an enclosed evaporator space and with an externally disposed condensor. A hygroscopic liquid is contained in the continuous length of capillary material for absorption of moisture in the evaporator space and for elimination of moisture outside the refrigerator wall. The two ends of the continuous length of capillary material are arranged in liquid-transmitting contact with each other so that the hygroscopic liquid flows in a closed circuit.

7 Claims, 3 Drawing Figures

DEVICE FOR EXTRACTING MOISTURE FROM A SPACE

Figure 1:
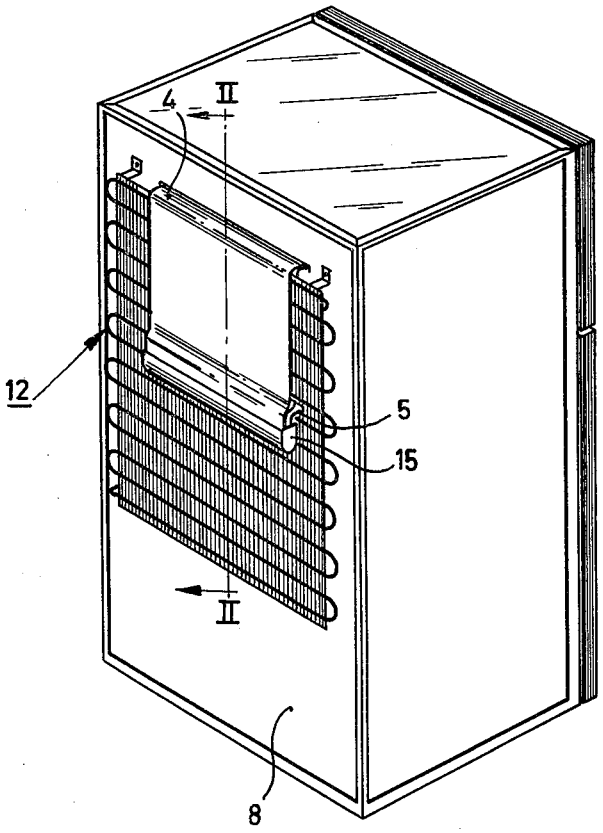

This invention relates to a device for extracting moisture from a space, which device includes a moisture-absorbing element which can contain a hygroscopic liquid.

Such a device is known from U.S. Pat. 3,594,990. This device consists of a cabinet with an inlet opening and an outlet opening, which can be connected to a space to be dehumidified. The cabinet contains an asbestos yarn desiccator which contains a desiccant. The desiccator moreover includes a heating element. The cabinet furthermore accommodates a motor-driven fan, which draws moist air from the space and passes it through the desiccator. The moisture is absorbed by the desiccant and dry air is discharged into the space. For removing the moisture from the desiccator, the inlet and outlet openings to the space are closed at regular intervals and different inlet and outlet openings which give access to the atmosphere are opened, whilst moreover the heating element is switched on. The drawbacks of this known construction are that extraction of moisture is effected discontinuously and that the device has a high power consumption.

It is an object of the present invention to provide a device which enables continuous dehumidification of a space and which furthermore requires minimum power.

For this purpose the invention is characterized in that the element extends from said space, where moisture is absorbed in the hygroscopic liquid, through a wall which bounds the space, to a second space where the moisture is evaporated from the hygroscopic liquid, the ends of the element being brought into liquid-transmitting contact with each other in such a way that the hygroscopic liquid flows in a closed circuit.

The moisture from the first space condenses near the element and the condensate is absorbed in the hygroscopic liquid. The hygroscopic liquid which is thus diluted is conveyed through the element to the second space, where the condensate is evaporated from the hygroscopic liquid. Subsequently, the hygroscopic liquid returns to the first compartment, so that the circulation of hygroscopic liquid is completed. By this process moisture is continuously extracted from the first space. The device basically comprises inexpensive components.

A preferred embodiment is characterized in that the closed circuit is obtained in that the two ends of the element are disposed in a reservoir for the hygroscopic liquid. In the circuit a natural circulation of hygroscopic liquid is obtained owing to the difference in specific gravity of the hygroscopic liquid which is diluted by the moisture in the first space and the hygroscopic liquid from which the moisture has been evaporated in the second space.

Another embodiment is characterized in that the closed circuit is obtained in that the two ends of the element are connected to each other. This again gives rise to a natural circulation of the hygroscopic liquid through the element.

Yet another embodiment is characterized in that the closed circuit is obtained in that the two ends are respectively disposed in reservoirs for the hygroscopic liquid, which reservoirs are connected to each other by means of a conduit which includes a pump. With this construction the pump assures the flow of hygroscopic liquid in the circuit.

The device is preferably used in a refrigerator which is then characterized in that the first space is the space inside the refrigerator, in which an evaporator is located and the second space is the space outside the refrigerator, the moisture-absorbing element in the first space being disposed near the evaporator and in the second space near the condensor of the refrigerator, and the wall which bounds the space being a refrigerator wall, in which openings are formed for the passage of the element, and in that the hygroscopic liquid has a melting temperature which is lower than the lowest temperature which can occur near the evaporator.

The moisture condenses near the evaporator, because at this location the lowest temperature prevails. For evaporation use is made of the heat from the condensor. Moreover, a major advantage of the use of the device in a refrigerator is that no ice is formed on the evaporator owing to the low melting temperature of the hygroscopic liquid.

Figure 2:
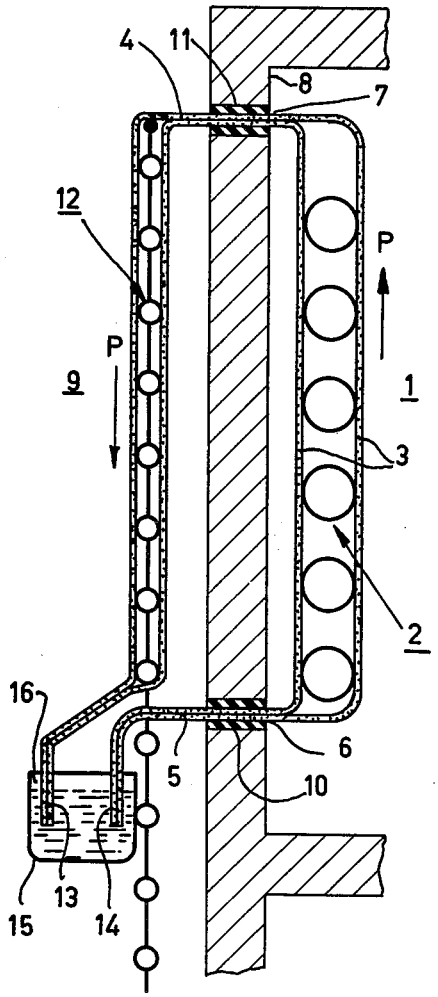
Figure 3:
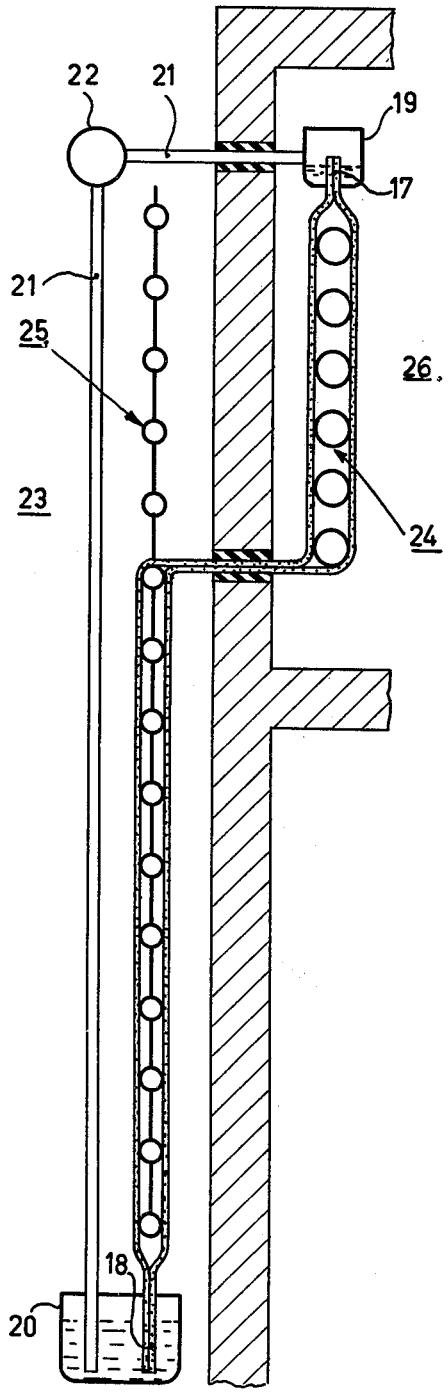

The invention will now be described in more detail with reference to the accompanying drawing, in which FIG. 1 is a perspective view of the rear of a refrigerator provided with a part of the device, FIG. 2 is a cross-section of the device taken along the line II—II of FIG. 1, and FIG. 3 is a similar cross-section of another embodiment of the device.

The evaporator space 1 of the refrigerator accommodates a vertically disposed evaporator 2, which is surrounded by a moisture-absorbing element 3. In the present example blotting paper is utilized, because this has a high absorption capacity and a low flow resistance. The portions 4 and 5 of this blotting paper are passed through two openings 7 and 6 in the rear wall 8 of the refrigerator to the space 9 outside the refrigerator. For the passage of the blotting paper through the rear wall seals 11 and 10 are provided. The portion 4 of the blotting paper adjoins the vertically disposed condensor 12. The blotting paper is formed into a double layer, which is split both near the evaporator 2 and the condensor 12, so that a layer of blotting paper is positioned on both sides of the evaporator and the condensor. The ends 13 and 14 of the blotting paper terminate in a reservoir 15 which is filled with a hygroscopic liquid 16. The hygroscopic liquid has a specific gravity greater than 1 and a melting temperature which is lower than the lowest temperature which can occur near the evaporator. Owing to the capillary properties of the blotting paper this will contain the hygroscopic liquid.

The operation of the device is as follows: Moisture which is present in the evaporator space 1 condenses on the blotting paper 3, because at this location the lowest temperature prevails. The moisture is absorbed in the hygroscopic liquid as water. The hygroscopic liquid is thus diluted and its specific gravity is decreases. Outside the refrigerator the hygroscopic liquid comes into proximity with the condensor, so that for the evaporation of water from the hygroscopic liquid use is made of the heat developed by the condensor. The hygroscopic specific gravity of the liquid is increased owing to the evaporation of the water. Thus, a difference in the specific gravity of the hygroscopic liquid in the evaporator space 1 and in the space 9 outside the refrigerator is obtained. As a result of this and the vertically arranged blotting paper near the evaporator 2 and the condensor 12, a natural circulation of hygroscopic liquid is obtained in the blotting paper in accordance with the arrows P. The circulation of the hygroscopic liquid is completed via the hygroscopic liquid in the reservoir 15. Instead of a reservoir of hygroscopic liquid for liquid-transmitting contact between the ends 13 and 14 of the blotting paper, it is alternatively possible to connect the ends themselves to each other, i.e., without a reservoir.

In another embodiment of the device used in a refrigerator (FIG. 3) the two ends 17, 18 of the blotting paper are respectively disposed in reservoirs 19, 20 for hygroscopic liquid. The reservoirs 19, 20 are connected to each other by a conduit 21, so that a closed circuit for the hygroscopic liquid is obtained. A pump 22 circulates the hygroscopic liquid, so that this circulation no longer depends on the difference in specific gravity of the hygroscopic liquid in the evaporator space 26 and that in the space 23 outside the refrigerator. The mositure-absorbing element can now be mounted on the evaporator 24 and the condensor 25 over a greater length, so that per unit of time more moisture can be absorbed and evaporated.

When the device is used in a refrigerator or freezer the melting temperature of the hygroscopic liquid must be low so as to prevent the formation of ice on the evaporator. The entire process is continuous and consumes little power. No separate periodically operating defroster is required, as is provided in most refrigerators, and which gives rise to a temporary reduction of the refrigerating action of the refrigerator. In the present embodiments an aqueous solution of $CaBr_2$ is used as the hygroscopic liquid, because this has good properties in respect of vapour pressure, melting temperature and surface tension. However, other hygroscopic liquids such as aqueous solutions of LiBr, $CaCl_2$ and LiCl can be used.

If the natural flow of the hygroscopic liquid through the moisture absorbing element is adequate, the device may also be used in a refrigerator with a horizontally disposed evaporator, the moisture-absorbing element then also being mounted horizontally.

It will be evident that the use of the invention is not limited to a refrigerator and the like. As an example, the invention may also be used to advantage in air conditioners. For the evaporation of water from the hygroscopic liquid use can then be made other energy sources, for example of solar heat.

What is claimed is:

1. A refrigerator, which comprises an external wall providing an enclosed evaporator space; an evaporator positioned in said space; a vertically disposed condensor arranged outside the refrigerator wall; a pair of openings formed in the refrigerator wall, said openings being respectively at the corresponding ends of the evaporator; a continuous length of capillary material extending past the evaporator in contact therewith, through one of said openings, and extending past the condensor in contact therewith; and a hygroscopic liquid contained in said continuous length of capillary material for absorption of moisture in said evaporator space and for elimination of moisture outside the refrigerator wall, said hygroscopic liquid having a melting temperature lower than the lowest temperature occurring adjacent the evaporator; the two ends of the continuous length of capillary material being in liquid-transmitting contact with each other so that the hygroscopic liquid flows in a closed circuit.

2. A refrigerator according to claim 1, in which the hygroscopic liquid has a specific gravity greater than 1.

3. A refrigerator according to claim 1, in which the continuous length of capillary material is formed of two layers respectively in contact with opposite sides of the evaporator and the condensor.

4. A refrigerator according to claim 1, which includes a reservoir for the hygroscopic liquid, the two ends of the continuous length of capillary material being disposed in said reservoir.

5. A refrigerator according to claim 1, in which the evaporator is also vertically disposed.

6. A refrigerator according to claim 1, which includes two reservoirs for the hygroscopic liquid, one end of the continuous length of capillary material being disposed in one of said reservoirs and the other end of said continuous length of capillary material being disposed in the other of said reservoirs; a conduit connecting said two reservoirs; and a pump included in said conduit to effect circulation of the hygroscopic liquid.

7. A refrigerator according to claim 1, in which the two ends of the continuous length of capillary material are connected directly to each other.

* * * * *